US005595028A

United States Patent [19]

Handzlik

[11] Patent Number: 5,595,028

[45] Date of Patent: Jan. 21, 1997

[54] TRUSS ROOF AND FLOOR JOIST STORAGE DEVICE

[76] Inventor: Walter A. Handzlik, 4808 May Field Rd., West Bend, Wis. 53095

[21] Appl. No.: 382,248

[22] Filed: Jan. 31, 1995

[51] Int. Cl.[6] ..... A47F 5/08

[52] U.S. Cl. ..... 52/32; 52/29; 52/39; 49/322; 49/347; 248/300; 248/343; 292/95; 312/245; 312/248

[58] Field of Search ..... 52/19, 29, 32, 52/39, 186; 49/322, 347; 312/245, 248, 30, 247; 248/343, 342, 323, 300; 182/77, 78; 292/95, 108; 108/42

[56] References Cited

U.S. PATENT DOCUMENTS

| | | | |
|---|---|---|---|
| 2,316,389 | 4/1943 | Atkinson | 248/300 |
| 3,331,645 | 7/1967 | Vercellotti | 312/248 |
| 3,359,695 | 12/1967 | Gazerro | 52/779 X |
| 3,464,749 | 9/1969 | Bishop | 312/248 |
| 3,759,488 | 9/1973 | Lukas | 254/8 R |
| 3,842,935 | 10/1974 | Frank | 182/81 |
| 3,846,005 | 11/1974 | Harper et al. | 312/248 |
| 4,286,508 | 9/1981 | Seebo, II | 98/43 R |
| 4,446,660 | 5/1984 | Miller et al. | 312/245 X |
| 4,699,437 | 10/1987 | Genereaux | 312/248 |
| 4,733,925 | 3/1988 | Duran et al. | 312/248 |
| 4,766,881 | 8/1988 | Pax | 312/248 X |
| 4,784,065 | 11/1988 | Brochand | 104/173.2 |
| 4,972,339 | 11/1990 | Gabrius | 248/343 X |
| 4,998,484 | 3/1991 | Groetzinger . | |
| 5,009,383 | 4/1991 | Chapman | 248/343 |
| 5,039,902 | 8/1991 | Schwarz | 312/248 |
| 5,050,706 | 9/1991 | Cole et al. | 182/78 |
| 5,075,148 | 12/1991 | Burcky et al. . | |
| 5,174,225 | 12/1992 | Reise et al. . | |
| 5,238,358 | 8/1993 | Higgins et al. | 414/463 |
| 5,239,795 | 8/1993 | Breaux . | |
| 5,242,219 | 9/1993 | Tomaka | 52/32 X |
| 5,346,036 | 9/1994 | Arisman et al. | 248/343 X |
| 5,407,261 | 4/1995 | Mercer | 312/248 |

FOREIGN PATENT DOCUMENTS

| | | | |
|---|---|---|---|
| 1300852 | 6/1961 | France | 312/245 |
| 4-149343 | 5/1992 | Japan | 52/779 |
| 8848 | 8/1894 | Switzerland | 49/347 |
| 663812 | 5/1979 | U.S.S.R. | 49/347 |

*Primary Examiner*—Wynn E. Wood
*Assistant Examiner*—Laura A. Saladino
*Attorney, Agent, or Firm*—Andrus, Sceales, Starke & Sawall

[57] ABSTRACT

A truss roof and floor joist storage device which provides access to and creates convenient storage space for a large variety of typically stored items from boxes to sporting equipment to tools and seasonal items. The device includes a large shelf which rotates up between the trusses of a garage or up against the floor joists in a basement. It has an optional pulley to raise and lower the shelf and two latches for safety. It is aesthetically compatible in either finished (drywalled) or unfinished space.

12 Claims, 3 Drawing Sheets

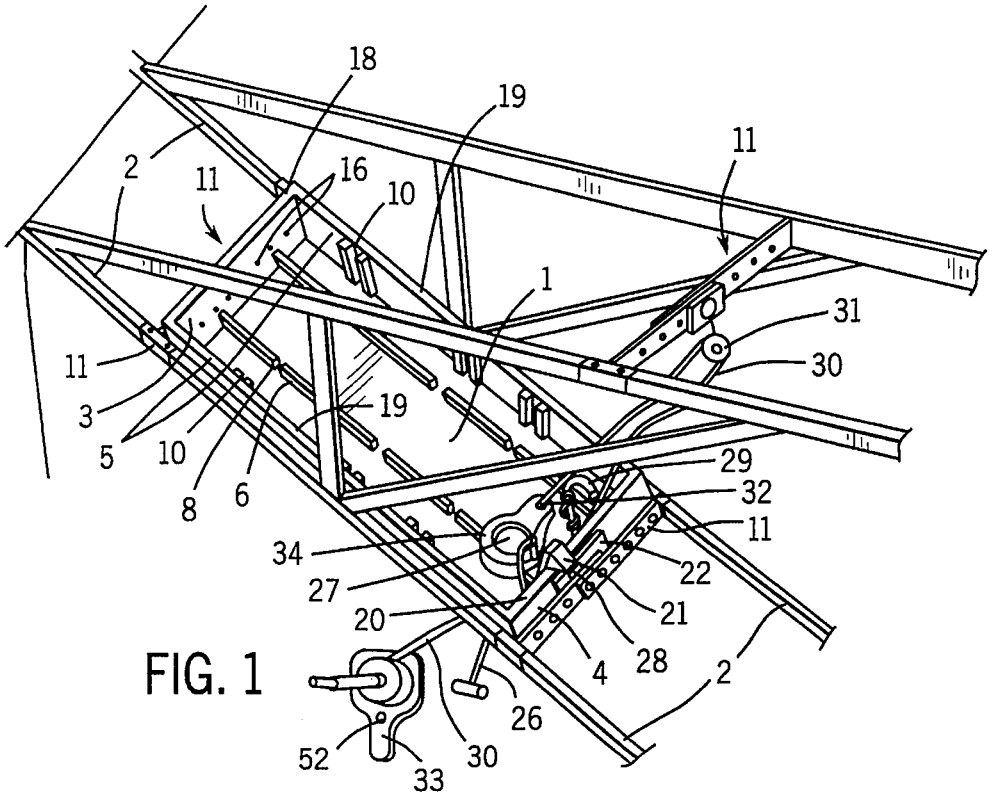
FIG. 1
FIG. 4
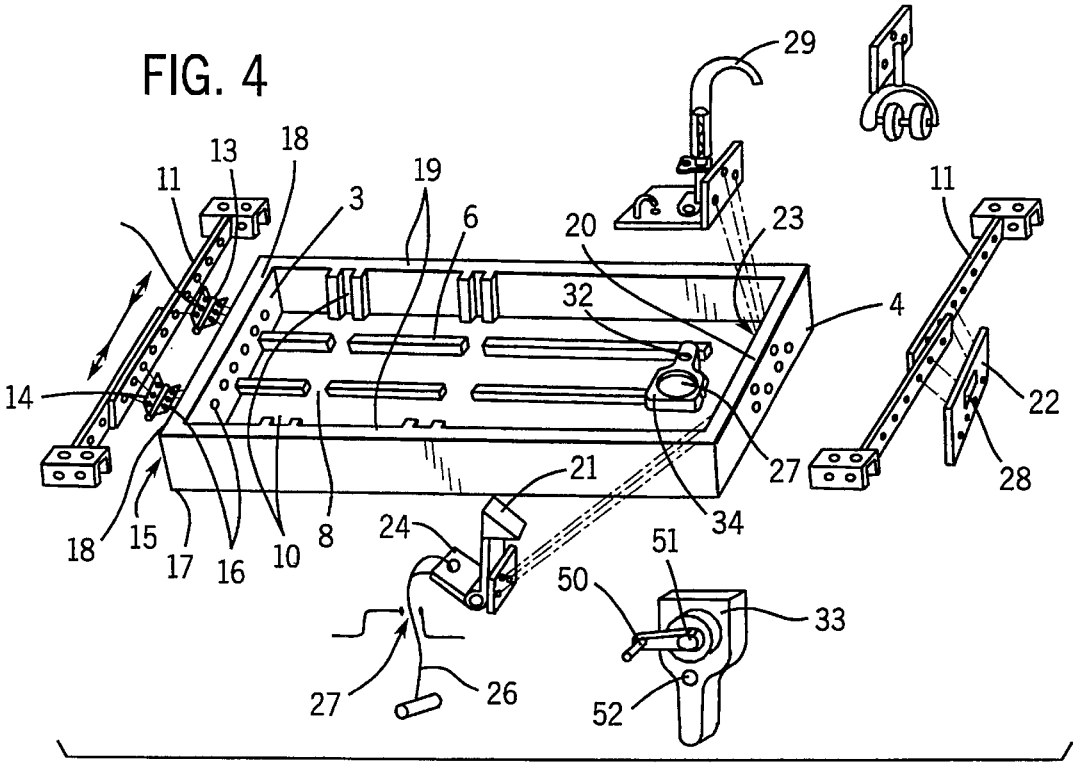

FIG. 2
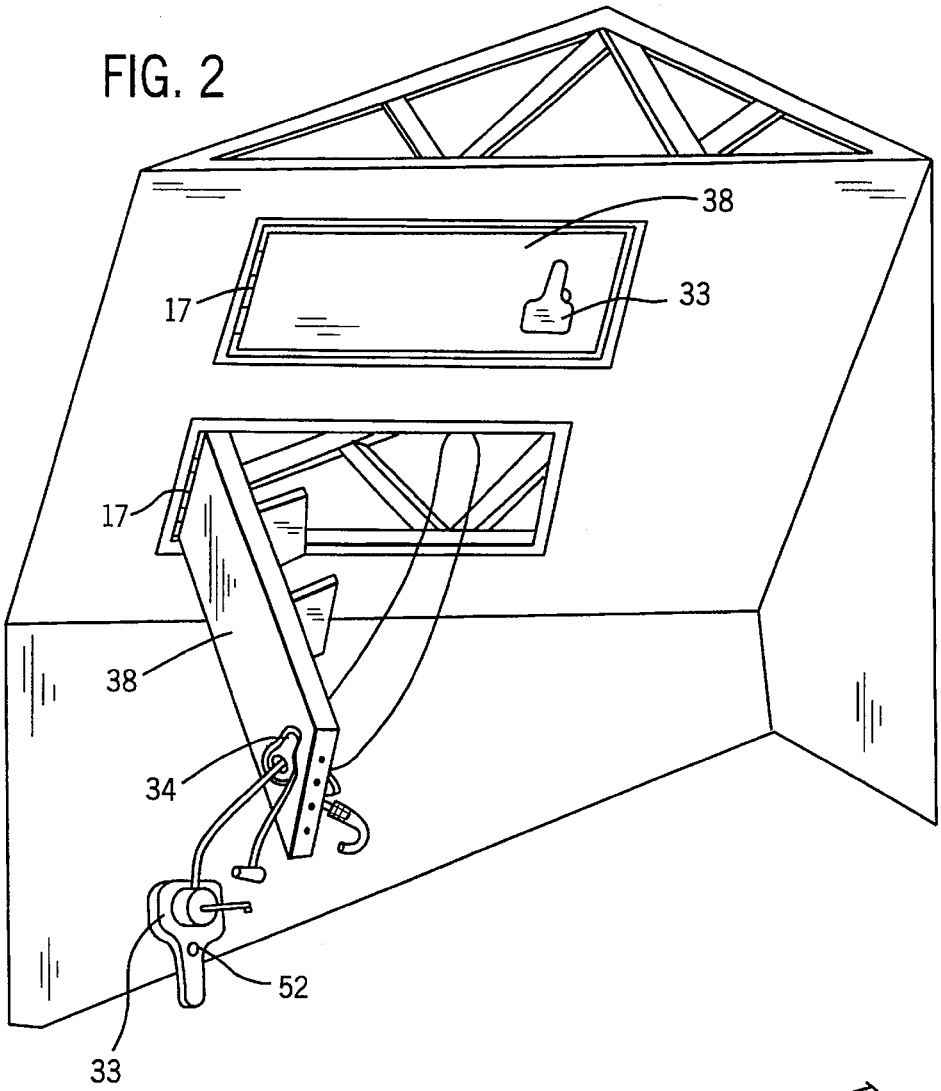
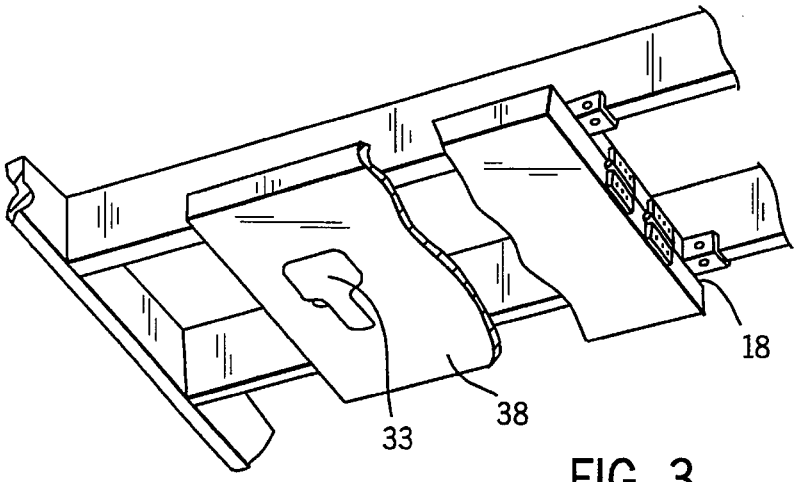
FIG. 3

TRUSS ROOF AND FLOOR JOIST STORAGE DEVICE

BACKGROUND OF THE INVENTION

The present invention relates to storage devices, and more particularly to storage devices integrated with and suspended from the trusses of a truss-roof building or the floor joists overhead in a basement of a building.

Attic space is synonymous with storage space. With the advent of pre-formed truss building techniques, attic space has been virtually eliminated. The advantages of trusses over stick-built, on-site roof support devices are well known and will continue to be the preferred building device. The space enclosed by the trusses under the roof is the same as in a roof built with rafters and floor joists, however the cubic volume is severely broken up by the component members of the trusses, making the space inefficient at best for storage access. With many garages in new home construction being drywalled in the interest of esthetics, the most commonly used "attic" storage space is virtually gone, accessible only by a small scuttle or trapdoor opening. Providing efficient, economical and esthetic storage space in areas available but inaccessible is desirable. While cabinet devices can provide esthetic storage, they use expensive floor space and are costly in themselves. Contributing cabinet space to seasonal storage or large items, such as bicycles is not practical, but at the present time there is no alternative. Efficiently accessing the space between the trusses, be the space drywalled or not, is a superior choice.

This same storage device can be used suspended from the floor joists overhead in a basement. Because of the limited depth of the floor joists, in a basement floor joist application, the storage unit would be suspended below the joists, whether the space was drywalled or not. With this application technique, adequate space would be available for the storage of many items, from spray and paint cans to power tools, fishing and hunting equipment seasonal home decorations.

SUMMARY OF THE INVENTION

The present invention provides a storage device which accesses the space over a garage or living space that is enclosed by a truss supported roof. The device provides a unit that fits conveniently between the lower- most horizontal members of the roof truss and is supported by them, providing a large space for the storage of a large range of items, both big and small. Where the space is drywalled, the unit is designed to be continuous with the drywalled surface and be compatible aesthetically. In a basement floor joist application the unit presents as a finished box surface mounted on the drywall.

In order to accomplish its intended function, The Truss Roof and Floor Joist Device comprises a large planar surface with supporting elements which allows it to be effectively suspended between the lowermost horizontal members of a truss. The planar surface is further attached to its supporting elements at one end of the planar surface by hinges, which allow it to be lowered rotatably from a horizontal, storage position, to a vertical, access position. The planar surface has top, bottom and side walls, which add ridigidity. The side walls and planar surface have slots and notches designed to accept shelves and accessaries to allow the convenient and efficient storage of a variety of items. At the end of the planar surface opposite from the hinges is attached a latch which engages a support element and supports the planar surface in a horizontal position when it is rotatably moved from the vertical position. It has attached to it, a short rope which can be left to hang down for frequent use, which releases the latch and allows the planar surface to be rotatably lowered. Also optionally available, is a simple pulley and rope, arranged to give the user a mechanical advantage in lifting the planar surface into its horizontal position. A simple hand-cranked reel for rope storage is provided. A recess on the visible surface of the planar surface when it is in the horizontal position, provides convenient and unobtrusive storage for the rope storage reel. The recess also provides space for the rope attached to the latch to be stored when the planar surface is lowered only occasionally as in seasonal storage use.

BRIEF DESCRIPTION OF THE DRAWINGS

The drawings illustrate the best mode presently contemplated of carrying out the invention.

In the drawings:

FIG. 1 is a top view in elevation of a truss-supported storage device constructed in accordance with the principles of the present invention;

FIG. 2 is a view of a dry-walled room with the front and left side walls removed, showing one storage unit in the horizontal position and a second unit, rotated down in a vertical position;

FIG. 3 is a view of the invention in a floor joist application;

FIG. 4 is an exploded view of the invention; and

DESCRIPTION OF THE PREFERRED EMBODIMENT

Figure 5A:
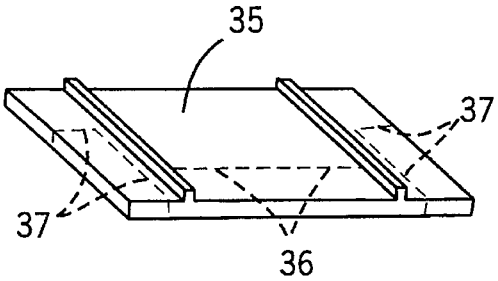
FIG. 5 is a view of the optionally changeable storing accessory racks along with the standard shelves.

Referring now to the drawings, FIG. 1 illustrates a planar surface storing unit generally designated by the numeral 1 for storing a variety of items. It is supported by the horizontal members 2 of a typical truss used in typical home and garage construction. It should be readily apparent that the planar storage unit 1 may also be suspended by other construction components such as floor joists overhead in a basement.

Figure 5D:
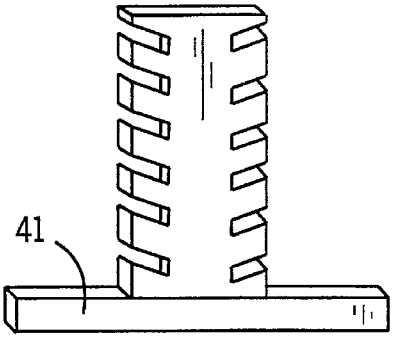
Figure 5B:
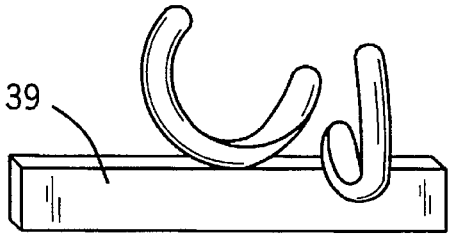
Figure 5E:
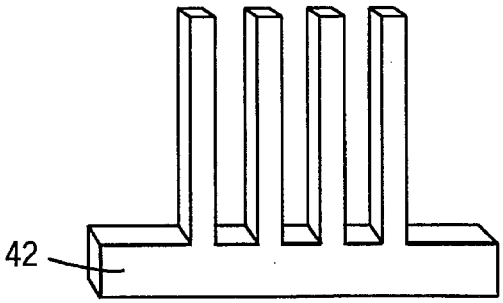
Figure 5C:
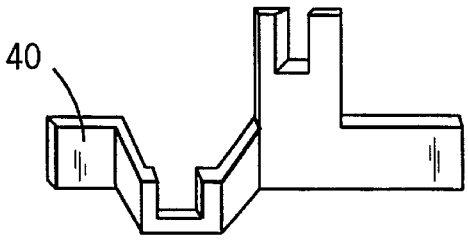
Figure 5F:
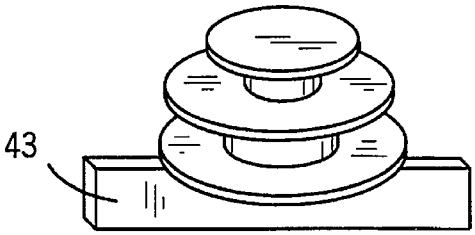

The storage unit planar surface i having upper wall 3 lower wall 4 and side walls 5 as well as ridges 6 the length of its inner storage facing surface 7 which create structural rigidity as well as provide containment for stored items. The side walls 5 and ridges 6 have grooves 10 and notches 8 to interchangeably accept the various storage accessory units 35 39 40 41 42 43 as shown in FIG. 5 which units will be discussed later in this description. The planar surface 1 is attached to the horizontal truss members 2 by the support members 11 as best seen in FIG. 4. The planar surface 1 is attached to its support members 11 by a pair of typical hinges 13 at the outer surface 15 of its upper wall 3. The supporting members 11 are narrowly adjustable and overlap so that holes 14 in support members 11 will align with holes 16 fixed in hinges 13 and upper wall 3 in either a truss application or floor joist application. In a truss application, the hinges 13 are mounted with their axis parallel to the bottom non-storage surface edge 17 of the upper wall 3 as best seen in FIG. 2. In the horizontal position the hinges 13 are closed upon themselves, and the bottom surface of the planar surface I is continuous with a drywalled surface. In a floor joist application the supporting members 11 would be narrowly overlapped and inverted. The hinges 13 are attached with their axis parallel to the top storage surface edge 18 of upper wall 3. In the horizontal position, the hinges 13 are in a fully open position and the planar surface 1 is surface mounted with the top edge 18, 19, 20 in contact with either the floor joists or a drywalled surface. It should be readily apparent that a narrower supporting member 11 and a narrower planar surface 1 could be designed to fit between floor joists, but vertical space available would be limited to the dimension of the joist member and most often would be too small to be practical. The small amount that the planar surface encroaches on the basement headroom is not critical, and it provides significant additional depth so as to make storage of a wide variety of items practical.

As seen in FIG. 4 the planar surface 1 is maintained in the horizontal position by a typical spring loaded latch 21 which engages a stop 22 which is attached to supporting members 11 which are attached to horizontal truss members 2 near to lower wall 4. Latch 21 is attached to the inner surface 23 of the lower wall 4 at its mid-point. Latch 21 is spring loaded so that it automatically catches stop 22 when rotatably moving planar surface 1 from a vertical position to a horizontal one. Latch 21 has a release arm 24 to which is attached a pull cord 26. Pull chord 26 is available through an opening 27. When the pull chord 26 is pulled it lowers release arm 24 which in turn releases the latch 21 from the stop 22 and the planar surface 1 is free to move rotatably to a vertical position. Stop 22 has an opening 28 which engages the latch 21 when used invertibly in a floor joist application. Also attached to the inner surface 23 of the lower wall 4 just lateral to the mid-point is a safety catch 29 spring loaded to move around a horizontal axis parallel to wall 4 and spring loaded in a vertical direction along its length to absorb the impact of its function which is to prevent unexpected free-falling downward rotation of the planar surface 1, If the planar surface 1 rotates downward uncontrolled for six inches the safety catch 29 engages the stop 22 and prevents further opening. Optionally as seen in FIG. 1 the safety catch 29 can have attached to it a rope 30 which goes through a pulley 31 attached to supporting member 11 and on down through a hole 32 making it accessible to the user, Pulling on the rope 30 raises and simultaneously releases the safety catch 29 so that the planar surface 1 can be lowered in a controlled fashion, The rope also gives the operator an opportunity to adjust to the amount of force which will be required to lower the planar surface controllably. Should the user choose not to use the rope 30 and pulley 31 a short chord 50 as seen in FIG. 4 is attached to the safety latch 29 and made available through hole 32 which when pulled with a slight raising of the planar surface 1 releases the safety latch 29 and allows the user to adjust to the force required to controllably lower planar surface 1 rotatably to its vertical position. A hand cranked reel 33 stores the length of rope 30 when the planar surface 1 is in a horizontal position with a depression 34 in the bottom surface 38 to store the reel 33. The crank handle 50 on the reel is foldable at 51 so it fits into hole 52, With the handle 50 folded at 51 and fitted into hole 52 the reel can neither be wound up or unwound, This provides a means for temporarily holding the planar surface 1 in a position less than full vertical toward horizontal to allow the loading of those items that store well horizontally but are difficult to load with the planar surface 1 in a The latch 21 release chord 26 can also be stored in depression 34 during seasonal use or release chord 26 can always hang down for frequent access. Concealed by the hand crank 33 stored in depression 34 is a hole 27 through which the latch 21 and the safety catch 29 are accessible by hand if necessary. It should readily be apparent that the weight of planar surface 1 and its stored items could be counter balanced by a spring mechanism in the public domain as seen in expired patents for disappearing attic stairs and the like.

FIG. 5 illustrates optional storage enhancing accessory attachments. It should readily be apparent that planar surface 1 may be used with other storage accessory items and should not be limited to those shown here. The standard shelf 35 slidably engages slots 10 and notches 8 on planar surface 1 best seen in FIG. 4. The standard shelf 35 in a floor joist application may require a modification by cutting along interrupted lines 37 and depending on joist depth also along dotted line 36. The bicycle storage accessories 39 and 40 hold two bicycles side-by-side but in opposite directions. Ski or fishing rod storage along with ski pole storage is provided by 41. Miscellaneous item stacking rack is 42. Garden hoses electrical extension cords or ropes can be stored on 43.

Various modes of carrying out the invention are contemplated as being within the scope of the following claims particularly pointing out and distinctly claiming the subject matter as the invention.

I claim:

1. An overhead storage device suspendable from building support members for storing items, said device comprising:

a storage unit having opposite ends;

first mounting means for mounting one end of said storage unit to a building support member, said first mounting means includes a hinge for permitting pivotal movement of said storage unit between a horizontal stored position and a vertical access position;

second mounting means for mounting the other end of said storage unit to a building support member, said second mounting means includes a latch to releasably hold said storage unit in said horizontal stored position; and a safety catch for permitting partial pivotal movement of said storage unit from said horizontal stored position while preventing free-fall of said storage unit when said latch is released, said safety catch includes a compressible spring which softens the catch action of said safety catch and a release means for releasing the safety catch to permit further pivotal movement of said storage unit to said vertical access position.

2. The overhead storage device of claim 1 wherein said first and second mounting means each include a support member spanning a pair of spaced, parallel roof trusses, and said storage unit is mounted between said roof trusses.

3. The overhead storage device of claim 1 wherein said first and second mounting means each include a support member spanning a pair of spaced, parallel floor joists, and said storage unit is mounted beneath said floor joists.

4. The overhead storage device of claim 1 wherein said safety catch further includes pivot means for pivotally mounting said safety catch between engaged and disengaged positions, and spring means for biasing said safety catch to said engaged position, and said release means includes a cord attached to said safety catch movable to pivot said safety catch from said engaged position to said disengaged position.

5. An overhead storage device suspendable from building support members for storing items, said device comprising:

a general rectangular planar surface;

a pair of end walls joined to said planar surface;

a pair of side walls joined to said planar surface such that said planar surface, said end walls, and said side walls combine to form a storage unit;

a pair of support members each securely attached between a pair of building support members;

a hinge means securely connected at a first side to one of said support members and securely connected at a second side to one of said end walls, such that said hinge means permits said storage unit to pivot between a substantially horizontal position and a substantially vertical position;

a latch mounted on said storage unit and engageable with the other of said support members to releasably hold said planar surface in the substantially horizontal position; and a spring loaded safety catch mounted on said storage unit, said safety catch engageable with the other of said support members for preventing the unexpected free-fall movement of said storage unit from the substantially horizontal position to the substantially vertical position when said latch is released, said spring loaded safety catch further including a release cord, said release cord releasing said safety catch to permit movement of said storage unit.

6. The overhead storage device of claim 5 wherein said latch is rotatable about a horizontal axis and includes a bias spring and a pull cord, such that applying force to said pull cord rotates said latch, thereby releasing said storage unit from the substantially horizontal position.

7. The overhead storage device of claim 5 further comprising a stop element mounted to one of said support members, said stop element having a latch opening which engages said latch to releasably hold said storage unit in the substantially horizontal position.

8. The overhead storage device of claim 7 wherein said safety catch engages said stop element to prevent the unexpected movement of said storage unit from the substantially horizontal position to the substantially vertical position.

9. The overhead storage device of claim 5 wherein said planar surface has an upper and a lower surface, said upper surface having a series of ridges and grooves which cooperate with a series of ridges and grooves contained on said side walls to provide storage for said items.

10. An overhead storage device suspendable from building support members for storing items, said device comprising:

a generally rectangular planar surface;

a pair of end walls joined to said planar surface;

a pair of side walls joined to said planar surface such that said planar surface, said end walls, and said side walls combine to form a storage unit;

a pair of support members each securely attached between a pair of building support members;

a hinge means securely connected at a first side to one of said support members and securely connected at a second side to one of said end walls, such that said hinge means permits said storage unit to pivot between a substantially horizontal position and a substantially vertical position;

a latch mounted on said storage unit and engageable with the other of said support members to releasably hold said planar surface in the substantially horizontal position;

a spring loaded safety catch mounted on said storage unit, said safety catch engageable with the other of said support members for preventing the unexpected free-fall movement of said planar surface from the substantially horizontal position to the substantially vertical position;

a release cord having a first end connected to said safety catch and a second end extending through said planar surface; and a pulley supported above said planar surface, said pulley engaging said release cord between said first and second ends, such that the combination of said cord and said pulley control the upward and downward pivotal movement of said storage unit.

11. The overhead storage device of claim 10 further comprising a rotatable hand crank reel connected to the second end of said cord, the rotation of said hand crank reel modifying the length of said cord extending through said planar surface and thereby controlling the pivotal movement of said storage unit.

12. The overhead storage device of claim 11 further comprising a depression contained in said planar surface, said depression sized to retain said hand crank reel in a storage position.

* * * * *